US006146238A

United States Patent [19]

Daiber

[11] Patent Number: 6,146,238

[45] Date of Patent: Nov. 14, 2000

[54] TOY STORAGE AND PLAY SCENARIO BOX

[76] Inventor: William K. Daiber, 16 Bonnywick Dr., Harrisburg, Pa. 17111

[21] Appl. No.: 09/098,641

[22] Filed: Jun. 17, 1998

[51] Int. Cl.[7] ..... A63H 3/52

[52] U.S. Cl. ..... 446/478; 446/476; 446/71; 446/75

[58] Field of Search ..... 446/71, 76, 80, 446/85, 108, 476, 478, 487, 488

[56] References Cited

U.S. PATENT DOCUMENTS

| | | | |
|---|---|---|---|
| 243,873 | 7/1881 | Dorn et al. . | |
| 1,130,818 | 3/1915 | Herman | 446/476 |
| 1,159,024 | 11/1915 | Herman | 446/478 |
| 1,766,194 | 6/1930 | Schubart . | |
| 2,059,964 | 11/1936 | Hempstone . | |
| 2,977,688 | 4/1961 | Redey . | |
| 3,363,360 | 1/1968 | Ryan . | |
| 4,055,250 | 10/1977 | Mayhew | 446/478 |
| 4,075,780 | 2/1978 | Linebaugh . | |
| 4,508,519 | 4/1985 | Becker | 446/478 |
| 4,696,652 | 9/1987 | Reeder et al. . | |
| 4,755,159 | 7/1988 | Templeton et al. . | |
| 5,055,083 | 10/1991 | Walker et al. . | |
| 5,085,608 | 2/1992 | Turner . | |
| 5,423,709 | 6/1995 | Summers | 446/478 |
| 5,435,769 | 7/1995 | Bertrand | 446/476 |
| 5,468,171 | 11/1995 | Taylor . | |
| 5,482,490 | 1/1996 | Weldon-Ming . | |
| 5,542,870 | 8/1996 | Westersund . | |

*Primary Examiner*—Sam Rimell
*Attorney, Agent, or Firm*—Webb Ziesenheim Logsdon Orkin & Hanson, P.C.

[57] ABSTRACT

A foldable toy storage container includes a base member, a plurality of side members and a top member which are hinged together. Each member is adapted to selectively receive, a releasable, replaceable scenery forming panel on at least one face thereof. The base member, side members and top member are movable between a first position forming a substantially box-shaped toy storage container and a second position forming a flat substantially rectangular play area with at least some of the scenery panels exposed.

18 Claims, 7 Drawing Sheets

TOY STORAGE AND PLAY SCENARIO BOX

BACKGROUND OF THE INVENTION

1. Field of the Invention

The present invention relates to a portable toy storage container, more particularly, to a toy storage container adapted to provide a play area for a user.

2. Background Information

Scenic representations have long been used in connection with toys to create a play environment to enhance the enjoyment of the toys. Additionally, it is well-known to incorporate these scenic representations into a toy storage container for the toys. For example, U.S. Pat. No. 5,542,870 to Westersund discloses a folding box diorama toy for displaying a scenic structure. The central base panel generally holds a central structure, such as a castle, volcano or grand stand depending on the specific play scenario. Hills, valleys, outbuildings, trees, painted scenes or shrubbery are provided on the central base and the folded outside panel as well as the vertical backdrops provided by the folded out triangular portions forming the top of the box. The box is designed to utilize standard outside panels for all dioramas and use less complicated drop-in inside panels for a variety of scenes and structures to be displayed on the inside of the relevant diorama.

Additionally, U.S. Pat. No. 5,085,608 to Turner discloses a collapsible desk with a doll house which unfolds to form a specific play area for the user and is designed to fold back up into a single wall mounted container. U.S. Pat. No. 5,055,083 to Walker et al. discloses a play store simulation which is stored in a box-like structure including walls movable to form a second floor. The display includes decorative background panels which can be interchanged as desired. U.S. Pat. No. 4,696,652 to Reeder et al. discloses a portable, foldable replica of a bank or post office which, in the stored condition, folds down to a single carrying case containing all the toy accessories therein. U.S. Pat. No. 4,755,159 to Templeton et al. discloses a carrying case which is usable as a toy building or as a toy playground. The sides and top may be hinged down to form an open playground arrangement or may be removed from the base, as desired. U.S. Pat. No. 243,873 to Dorn et al. discloses a doll house with hinged sides, back and roof in which several parts, when folded, form a box containing the furniture and other articles which are store within it. U.S. Pat. No. 5,482,490 to Weldon-Ming and U.S. Pat. No. 3,363,360 to Ryan also disclose various collapsible doll house arrangements which can be unfolded from a box to form a play area, as desired. The above-described prior art is representative of a large collection of knockdown/foldable toy holding or scene forming containers.

The difficulty with the above-described prior art is that much of the described structures are limited to a single type of play scenario. Additionally, when folded to form the play area, the play area takes the awkward shape of a cross-shaped, folded down box or other non-uniform shape. Consequently, there is a need for a toy storage container of a simple construction which can be moved between a position forming the storage container and a play position which includes a flat, substantially rectangular play area to better accommodate the user. It is the object of the present invention to overcome the aforementioned drawbacks of the prior art.

SUMMARY OF THE INVENTION

The present invention provides a foldable toy storage container which includes a base member, a plurality of side members and a top member which are hinged together. Each of the members are adapted to selectively receive a releasable scenery forming panel on at least one face thereof. The base member, side members and top member are movable between a first position forming a substantially box-shaped storage container and at least a second position forming a flat substantially rectangular play area with at least some of the scenery forming panels exposed on the play area.

In one embodiment of the present invention, the base is directly attached to four side members with two of the side members including extensions pivotably attached on opposite sides thereof. The top member is directly hinged to one side member with the top member additionally including two extensions pivotably attached on opposite ends thereof.

The toy storage container of the present invention may additionally be movable to a third position forming a substantially rectangular first play area with a background extending substantially perpendicular to the play area and extending substantially along the entire length of the play area. Additionally, an upper level may be attached to the background which is spaced from and extends substantially parallel to the rectangular play area thereby forming two level play area. The present invention further includes a scene forming structure which may be stored within the foldable toy storage container. The scene forming structure may include a body forming a hollow interior with at least one extension member telescopically received in the hollow interior of the body with at least one door attached to the body providing access to the hollow interior. The scene forming structure may be, for example, a representation of a mountain including a ski slope on one surface and a rock climbing cliff on another. The mountain may include a pair of telescoping members received within the body. The scene forming structure may be extended to a position extending beyond the base member of the container.

These and other advantages of the present invention will be clarified in the detailed description of the preferred embodiments taken together with the attached figures wherein like reference numerals represent like elements throughout.

DESCRIPTION OF THE PREFERRED EMBODIMENTS

Figure 1:
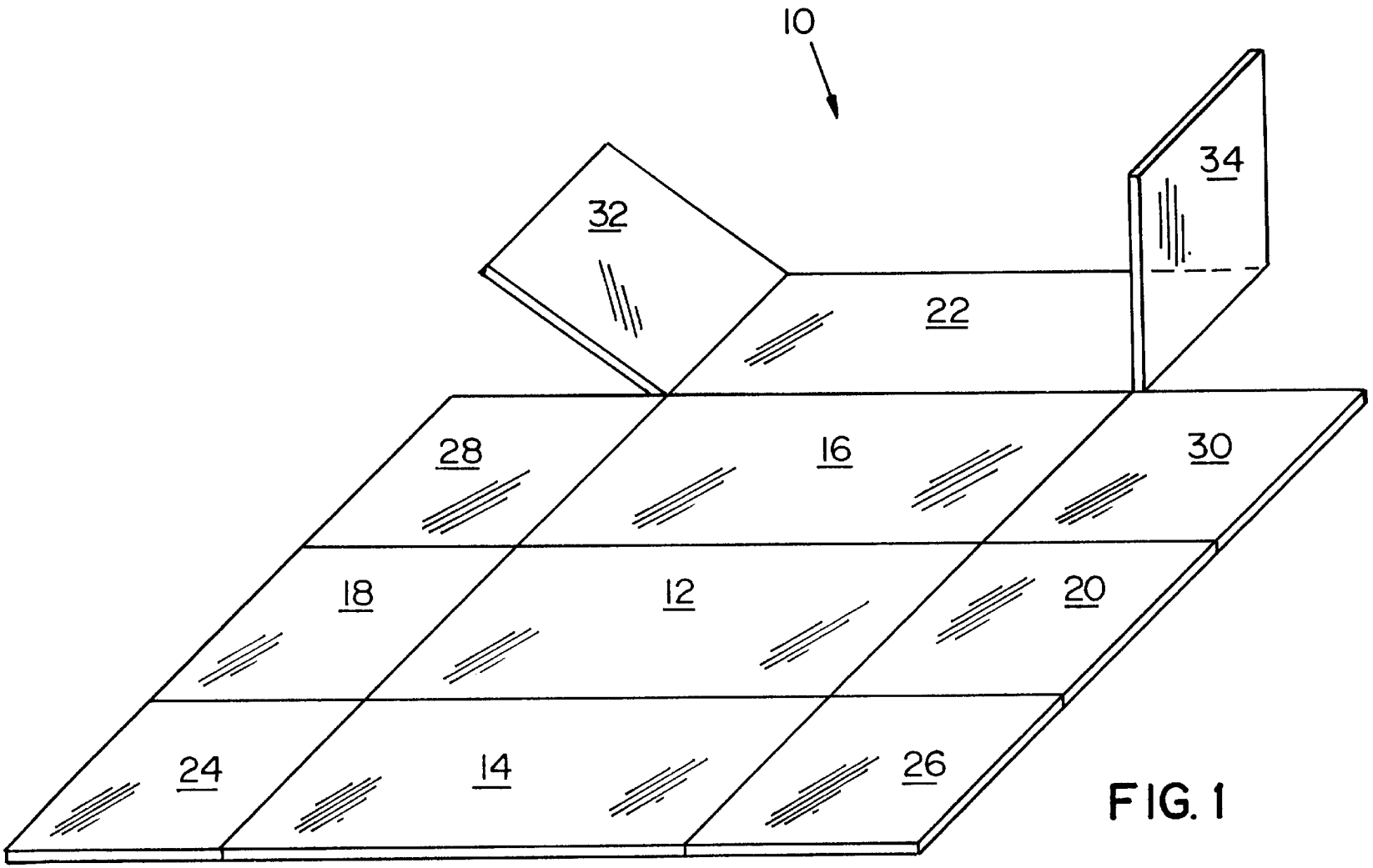
FIG. 1 schematically illustrates a foldable toy storage container of the present invention in a substantially folded out position.
Figure 2:
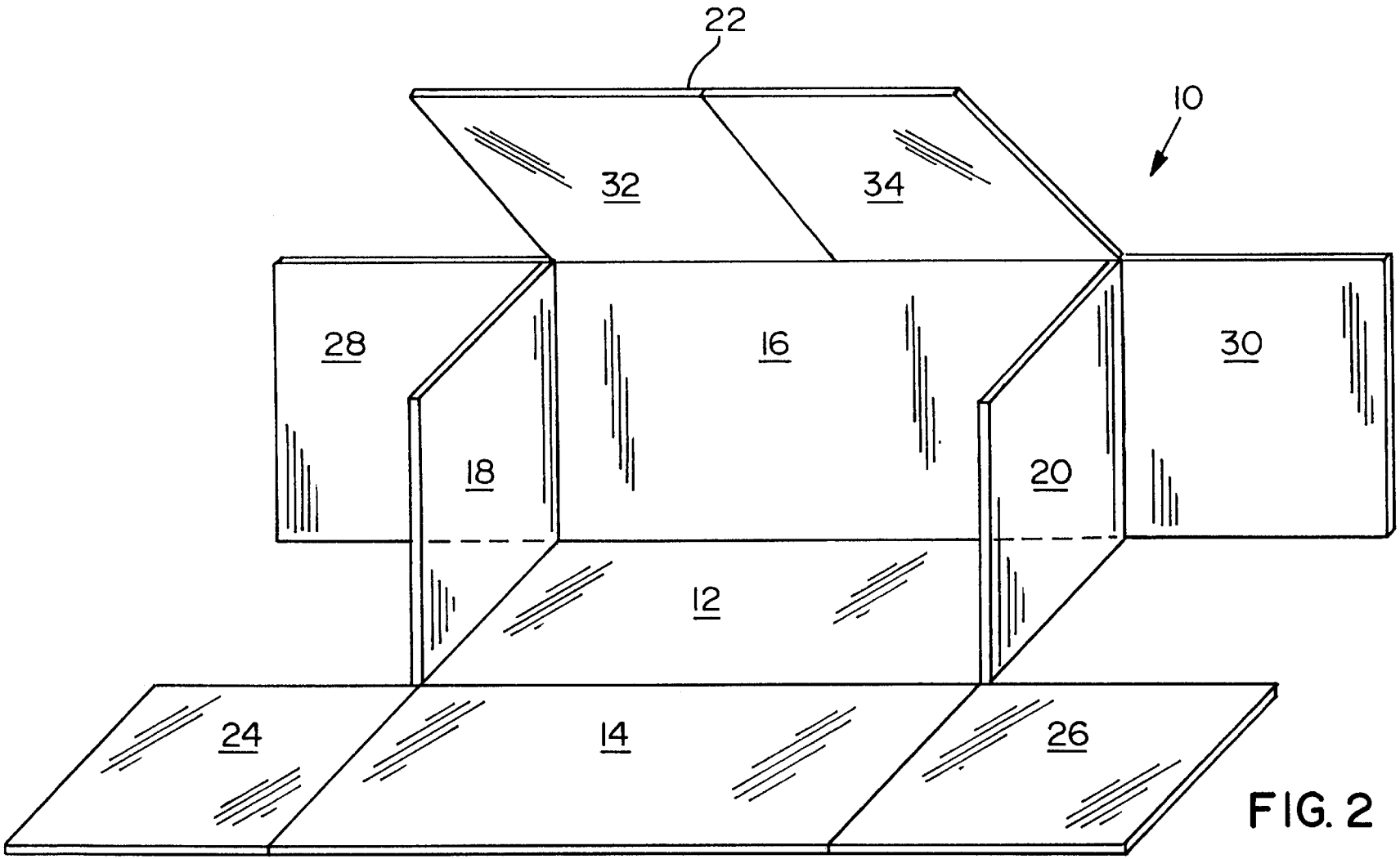
FIG. 2 schematically illustrates the foldable toy storage container of FIG. 1 in a partially folded up position.
Figure 3:
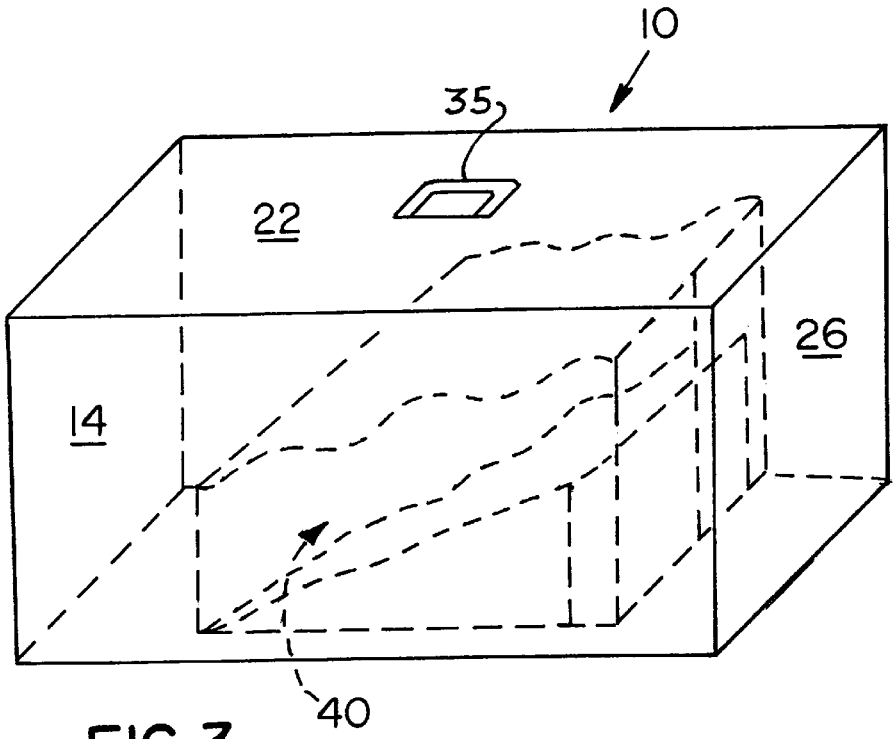
FIG. 3 schematically illustrates the foldable toy storage container of FIG. 1 in a folded up box-shaped toy storage configuration.

FIG. 3 illustrates the movable toy storage container 10 in a box-shaped, substantially rectangular toy storage configuration. FIG. 1 illustrates the container 10 in substantially a laid out arrangement forming a flat substantially rectangular play area as will be described. The container 10 includes a base member 12 which, referring to FIGS. 1 and 2, is directly hinged to a front side member 14, a rear side member 16, a left side member 18 and a right side member 20. The rear side member 16 is hinged to a top member 22 on a side opposite from the hinge connection to the base member 12.

As shown in FIG. 1, the front side member 14 is hinged to a left front side extension 24 and a right front side extension 26 on opposite ends thereof. In a similar fashion, the rear side member 16 is hinged to a left rear side extension 28 and a right rear side extension 30 on opposite ends of the rear side member 16. Additionally, the top member 22 is hinged to a top left extension 32 and a top right extension 34 on opposite ends of the top member 22. The extensions 24, 26, 28, 30, 32 and 34 allow for the container to be folded down into a flat substantially rectangular play area essentially as illustrated in FIG. 1. FIG. 1 shows the top left extension 32 and top right extension 34 in a slightly elevated position solely to show the folded relationship. In the rectangular play area, these elements would be folded coplanar with the remaining elements to form the rectangular play area, as will be evident to those of ordinary skill in the art.

As evident in FIGS. 2 and 3, the elements of the container 10 can be folded up into the box-shaped storage configuration illustrated in FIG. 3. In movement to the box-shaped storage container illustrated in FIG. 3, it will be evident that the extensions 24, 26, 28, 30, 32 and 34 can be moved to overlap the attached front side member 14, rear side member 16 or top member 22. Alternatively, the extensions 24, 26, 28, 30, 32 and 34 can overlay the respective left side member 18 or right side member 20.

The figures are only intended to schematically illustrate the container 10 of the present invention. The hinge structures are not shown in detail. Any conventional hinge structure providing the desired flexibility and durability may be utilized between directly attached elements or members. Additionally, the connecting mechanisms for attaching and interconnecting the members the box-shaped configuration is not illustrated in detail. Any conventional attachment or connecting mechanism may be utilized. Preferably, snap type, tight friction fit connections for attaching the side edges to the respective faces of the members will be utilized. Additionally, connection members may be utilized for attaching the faces of overlaying members, such as attaching one of the extensions to the front side member 14, rear side member 16, top member 22, left side member 18 or right side member 20 depending on the configurations discussed above.

Figure 4:
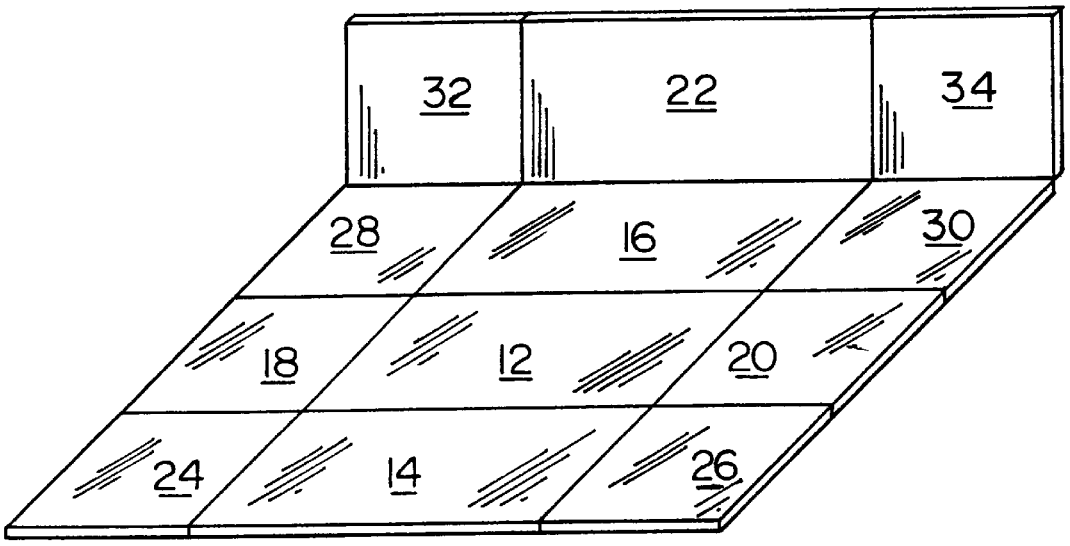
FIG. 4 schematically illustrates the toy storage container of FIG. 1 in another play area forming configuration.
Figure 5:
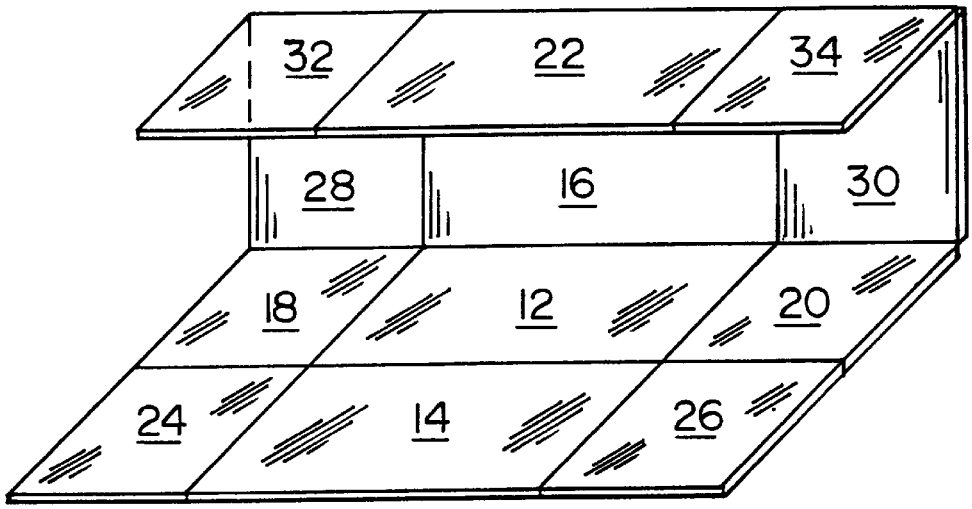
FIG. 5 schematically illustrates the toy storage container of FIG. 1 in another play area forming configuration.

FIGS. 4 and 5 illustrate two alternative play configurations for the container 10 of the present invention. In FIG. 4, a background is formed by top member 22, top left extension 30 and top right extension 34. The background or backdrop extends substantially perpendicular to a substantially flat rectangular play area formed by the remaining components of the container 10. As illustrated, the background extends along the entire length of one side of the flat play area. FIG. 5 illustrates another configuration which includes a background extending along the length of one side formed by rear side member 16, left rear extension 28 and right rear extension 30. Additionally, an upper play area is formed by the top member 22, top left extension 32 and top right extension 34. The upper play area is spaced from and substantially parallel to the flat substantially rectangular play area formed by the remaining components of the container 10. The two-level play arrangement illustrated in FIG. 5 may be utilized in play scenarios involving a need for multiple levels. For example, the upper level may represent the surface of the sea with the lower level representing the sea floor. Other multi-level examples include: a cave, a mine or multi-levels of a building. Depending on the strength of the particular hinge structure in the multilevel arrangement illustrated in FIG. 5, it may be appropriate to incorporate additional posts or supports for supporting the outer edge of the upper play area. These supports can be contained within the structure with the toys held in the container 10.

Figure 16:
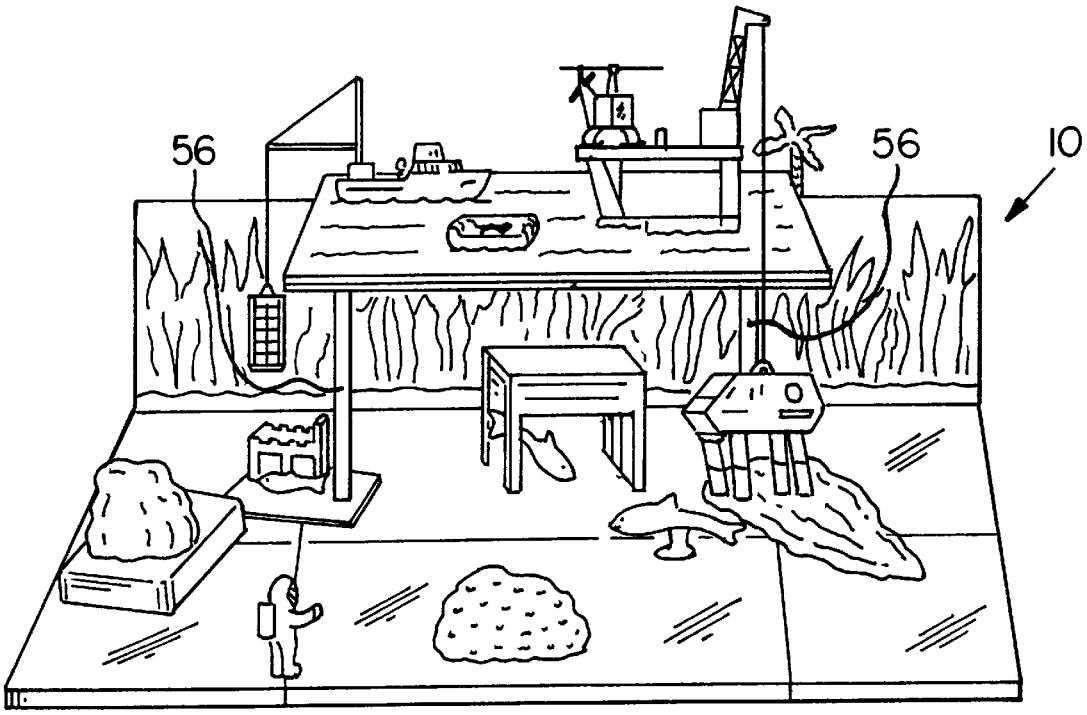
FIG. 16 illustrates the toy storage container of FIG. 1 in operation in a position similar to FIG. 5.

FIGS. 4 and 5 are intended to be merely representative examples of the wide variety of play arrangements and configurations which can be set up with the container 10 of the present invention. For example, in FIG. 4, the right side member 20, right front side extension 26 and right rear side connection 30 may be additionally raised to form a backdrop extending along two sides of the rectangular play area. In FIG. 5, the top left extension 32 and/or the top right extension 34 may be overlapped with the top member 22 to provide a smaller upper level play area, as shown in FIG. 16. These modifications are merely intended to illustrate some of the various different configurations possible with container 10 of the present invention.

Figure 6:
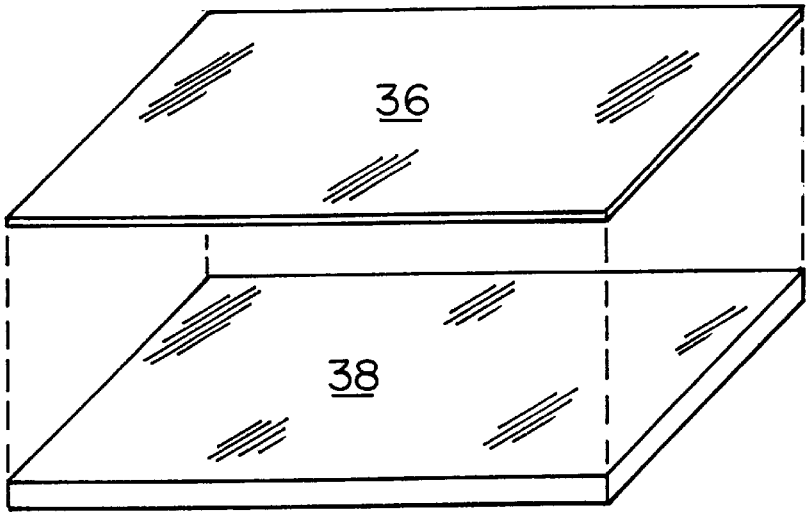
FIG. 6 schematically illustrates the releasable scenery forming panels for the individual components of the toy storage container illustrated in FIG. 1.

FIG. 6 illustrates are important feature of the present invention in that each member 12, 14, 16, 18, 20, and 22 as well as each extension 24, 26, 28, 30, 32 and 34 of the container 10 are adapted to selectively receive a releasable, scenery forming panel 36 on at least one face thereof, as schematically illustrated in FIG. 6. All of the members 12, 14, 16, 18 and 20 and extensions 24, 26, 28, 30, 32 and 34 are represented in FIG. 6 by generic element 38. As shown by comparing FIGS. 1 and 5, the top member 22, top left extension 32 and top right extension 34 may require a scenery forming panel 36 on either side thereof depending on the play configuration desired. As will be apparent to those of ordinary skill in the art, in the play position, the scenery forming panel 36 for each appropriate element 38 will be exposed when in the desire play configuration.

The scenery forming panels 36 may be attached to the element 38 in any conventional, easily releasable fashion, such as snap-type connections. The scenery forming panels 36 may simply be a printed scenery, may include three dimensional scenery forming structure thereon or may further include attaching elements for receiving specific toys or accessories to be attached directly thereto.

Figure 7:
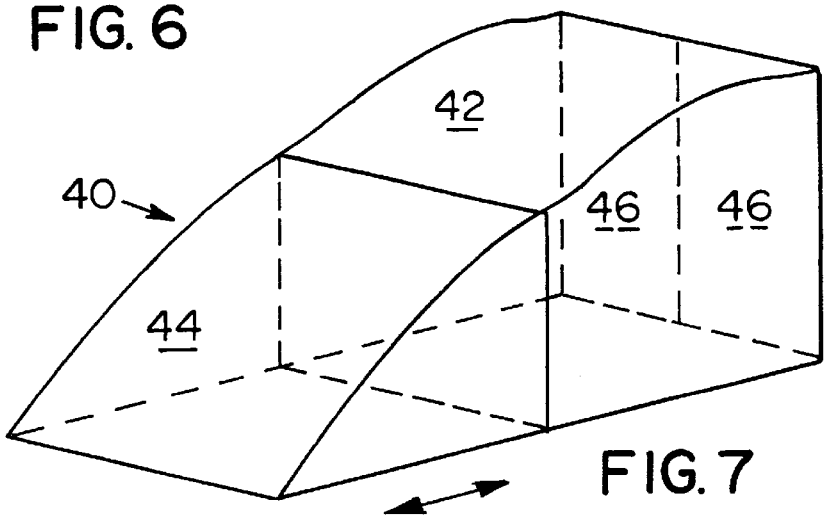
FIG. 7 schematically illustrates one embodiment of a scene forming structure according to the present invention in an extended position.
Figure 8:
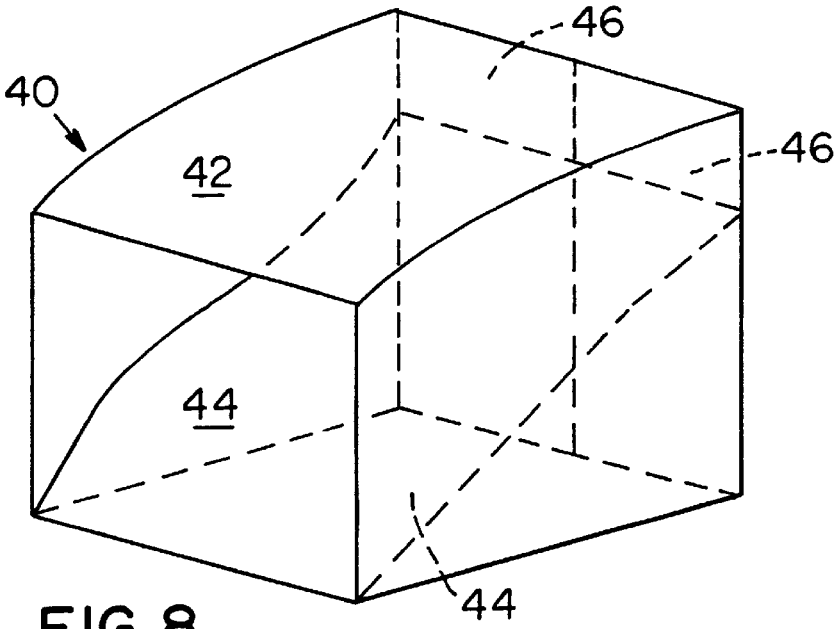
FIG. 8 schematically illustrates the scene forming structure of FIG. 7 in a retracted stored position.

As schematically illustrated in FIG. 3, the container 10 may include a scenery forming structure 40, as illustrated in FIGS. 7 and 8. The scenery forming structure shown in FIG. 7 is a representation of a mountain. This scenery forming structure 40 includes a hollow body 42 which telescopingly receives an extension 44 therein. The scenery forming structure 40 additionally includes doors 46 to provide access to the hollow interior of the body 42 for storage of toys and the like. As discussed, the scenery forming structure 40 illustrated in FIGS. 7 and 8 is a representation of a mountain with a ski slope on one surface thereof and a cliff for rock or mountain climbing scenarios on at least another surface such as the doors 46.

As evident in FIG. 3, in the collapsed or retracted position illustrated in FIG. 8, the scenery forming structure 40 fits within the box-shaped container 10 with the body 42 having a profile less than the base member 12. It is anticipated that, in the extended position shown in FIG. 7, the scenery forming structure 40 will extend beyond the profile of the base member 12 which is why the separate extension 44 is utilized.

In the play scenarios suggested by the mountain formed by the scenery forming structure 40, the panels 36 on the top member 22, right side member 20, left side member 18 and extensions 24, 26, 28, 30, 32 and 34 will include appropriate winter scenes, such as a frozen lake, ice skating/hockey rink and other appropriate mountain/winter scenes, as will be evident to those of ordinary skill in the art. The scenery forming structure 40 may be attached to the base member 12 or merely set thereon allowing the user to move the structure 40 around on the rectangular play area, as desired. Additionally, the scenery forming structure 40 may be used separate from the container 10 as its own storage container.

Figure 9:
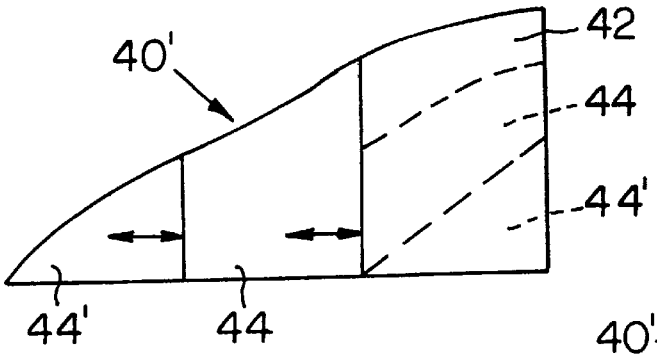
FIG. 9 schematically illustrates a scene forming structure according to another embodiment of the present invention.
Figure 10:
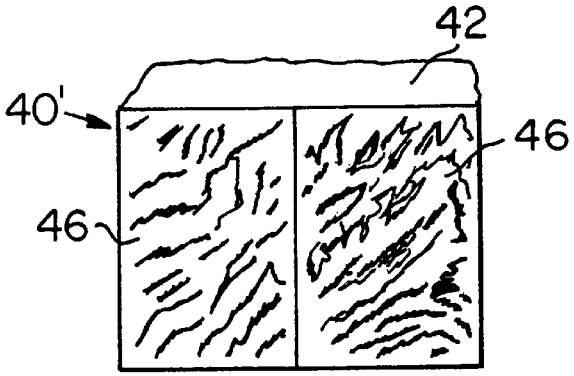
FIG. 10 is a schematic rear view of the scene forming structure illustrated in FIG. 9.
Figure 11:
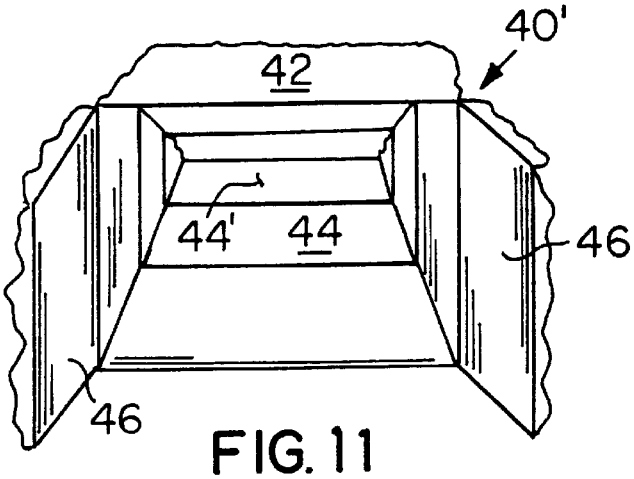
FIG. 11 is a schematic rear view of the scene forming structure illustrated in FIG. 9 with doors thereof open to illustrate the hollow interior thereof.

FIGS. 9, 10 and 11 illustrate a scenery forming structure 40' substantially similar to the scenery forming structure 40 illustrated in FIGS. 7 and 8. The scenery forming structure 40' includes a hollow body 42 with a pair of telescoping extensions 44 and 44' contained therein. Doors 46 also provide access into the hollow body 42, as shown in FIGS. 9 and 10. The scenery forming structure 40' is a mountain as discussed above with the scenery forming structure 40. Scenery forming structure 40' allows for further extension of the structure by the provision of a pair of telescoping extensions 44 and 44'. The scenery forming structure 40' operates substantially the same as scenery forming structure 40 discussed above.

Figure 12:
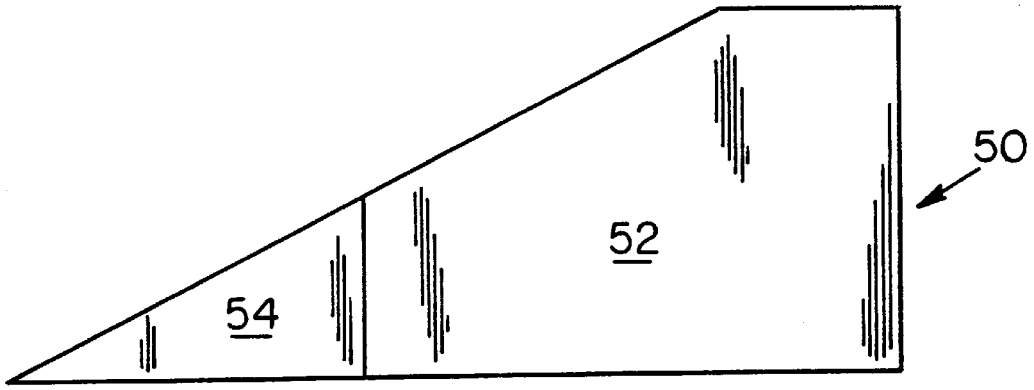
FIGS. 12–14 schematically illustrate a scene forming structure according to another embodiment of the present invention in an extended and a retracted position.
Figure 13:
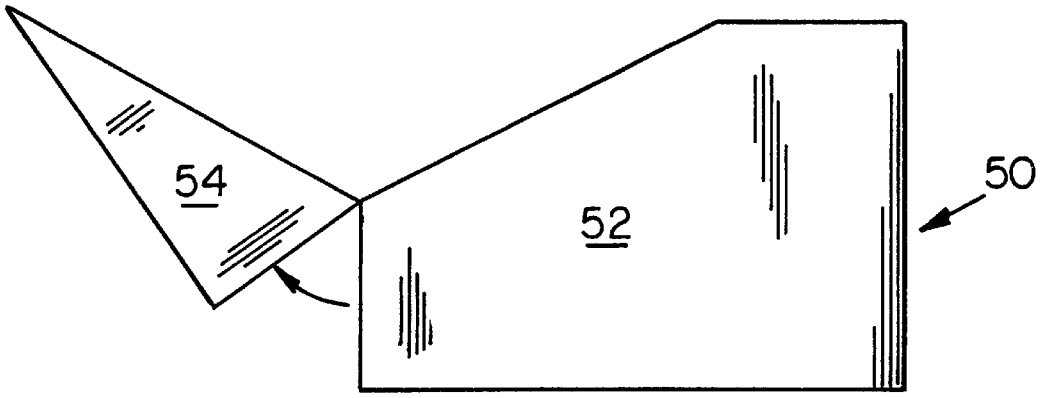
Figure 14:
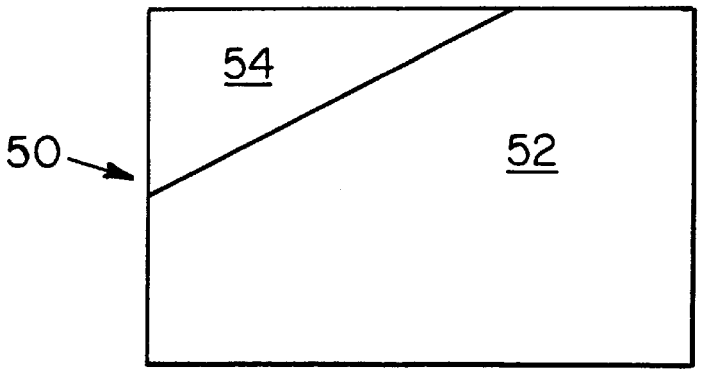

FIGS. 12–14 illustrate a scenery forming structure 50 according to another embodiment of the present invention with the scenery forming structure 50 including a body 52 and hinged extension 54 attached thereto. The body 52 may be hollow with access doors (not shown) into the hollow interior for storage. Similar to scenery forming structures 40 and 40' discussed above, the scenery forming structure 50 is also a representation of a skiing-type mountain. The scenery forming structure 50 is intended to illustrate another type of extendable scenery forming structure which may be incorporated into the container 10 of the present invention. As discussed above, the scenery forming structure 50 may also be used without the associated container 10.

Figure 15:
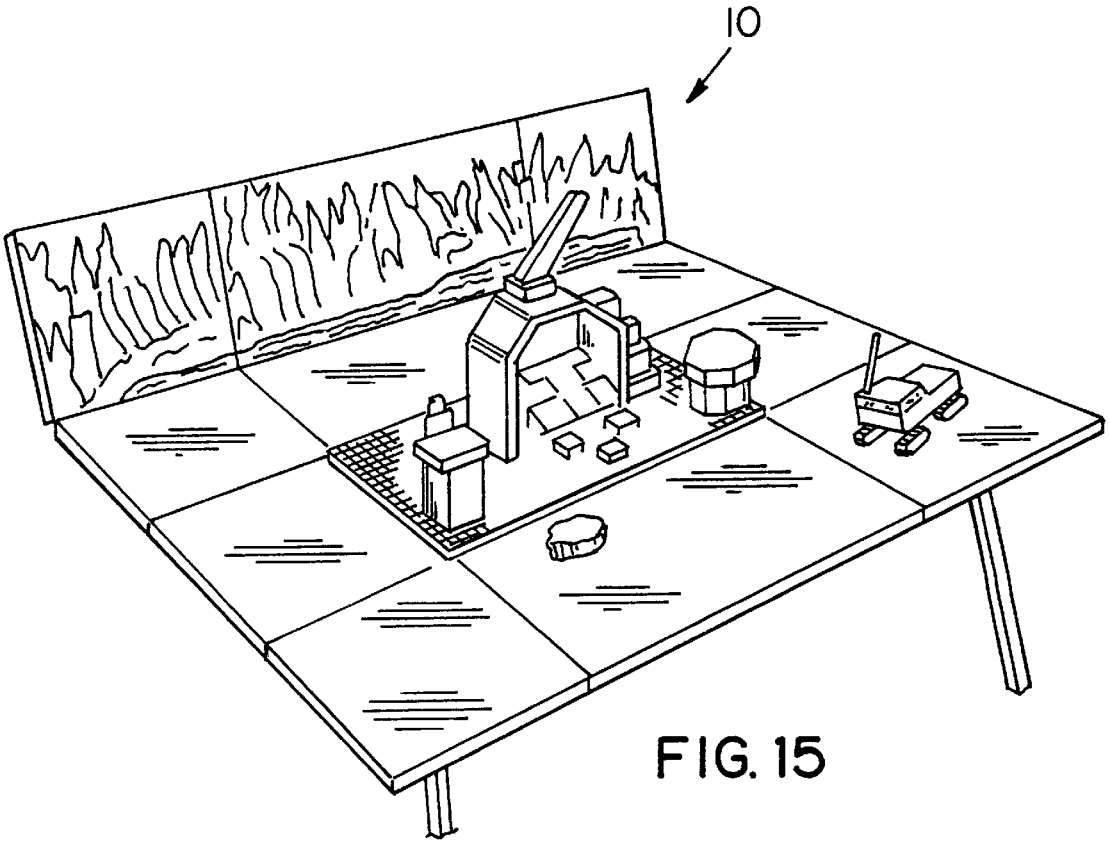
FIG. 15 illustrates the toy storage container of FIG. 1 in operation in a position similar to FIG. 4.

FIGS. 15 and 16 illustrate the container 10 in operation in two different play arrangements similar to those illustrated in FIGS. 4 and 5 discussed above. FIGS. 15 and 16 illustrate the container 10 together with the toys and accessories which may be contained within the container 10 when in the stored position shown in FIG. 3. Specifically, FIG. 15 illustrates an undersea play environment with the panels on the rectangular play surface representing the ocean floor with an appropriate background provided and extending substantially perpendicular to the play surface along substantially the entire length of the play surface. FIG. 16 illustrates a similar ocean playground with an upper play area representing the upper ocean surface. Supports 56 are illustrated for supporting the top member 22. Additionally, the top left extension 32 and top right extension 34 are folded onto the top member 22 to provide greater access to the lower rectangular play area. FIGS. 15 and 16 are merely intended to be representative of the types of play arrangements available with the present invention. The present invention is designed to provide a portable toy storage container which can be used to create a wide variety of play scenarios. It is anticipated that a single container 10 may be sold with various collections of panels 36 to provide a wide variety of possible display scenarios to be easily constructed by the user with a single container 10.

Another use of the present invention is to permanently attach the panels 36 to the respective elements 38 such that a single container 10 represents a single theme, although multiple play configurations are still possible such as shown in FIGS. 15 and 16. In this use, the advantage of the present invention would be the manufacture of the container 10 which can use the same container configuration with distinct panels 36, and may sell the single themed container 10 with associated enclosed accessories.

The specific embodiments of the present invention described herein are intended to be illustrative only to the present invention and not restrictive thereof. Consequently, it will be apparent to those of ordinary skill in the art that various modifications may be made to the present invention without departing from the spirit and scope thereof. The scope of the present invention is intended to be defined only by the appended claims and equivalents thereof.

I claim:

1. A foldable toy storage container comprising:

a base member, a plurality of side members and a top member which are hinged together, each said member adaptable to selectively receive a scene forming panel on at least one face thereof, wherein said base member, said side members and said top member are movable between a first position forming a substantially box-shaped toy storage container and a second position forming a flat substantially rectangular play area with at least some of said faces which are adaptable to receive the scene forming panels thereon exposed, wherein said base member is directly attached to four said side members, wherein two of said side members include extensions on opposite ends thereof.

2. The foldable play storage container of claim 1 wherein said base member, side members and top member are movable to a third position which includes a flat substantially rectangular play area and a background extending perpendicular along a length of one side of said play area.

3. The foldable toy storage container of claim 2 wherein said third position further includes an upper level attached to said background, said upper level spaced from and substantially parallel to said substantially rectangular play area.

4. The toy storage container of claim 1 wherein said base member is directly attached to four said side members, wherein two of said side members include extensions on opposite ends thereof.

5. The toy storage container of claim 1 wherein said top member is attached to one said side member.

6. The toy storage container of claim 5 wherein said top member includes two extensions on opposite ends thereof.

7. A foldable toy storage container comprising:

a base member, a plurality of side members and a top member which are hinged together, each said member adaptable to selectively receive a scene forming panel on at least one face thereof, wherein said base member, said side members and said top member are movable between a first position forming a substantially box-shaped toy storage container and a second position forming a flat substantially rectangular play area with at least some of said faces which are adaptable to receive the scene forming panels thereon exposed; and a scene forming structure stored within said box-shaped toy storage container.

8. The toy storage container of claim 7 wherein said scene forming structure is extendable beyond said base member when said base member, said side members and said top member are in said second position.

9. The toy storage container of claim 7 wherein said scene forming structure includes a plurality of telescoping members.

10. The toy storage container of claim 7 wherein said scene forming structure includes a hollow interior with at least one door for access to said hollow interior of said scene forming structure.

11. The toy storage container of claim 7 wherein said scene forming structure is a representation of a mountain including a representation of a ski slope on one surface thereof and a cliff on another surface thereof.

12. The toy storage container of claim 11 wherein at least a portion of said representation of said mountain is movably hinged to a position extendable beyond said base member.

13. The toy storage container of claim 1 further including a scene forming structure stored within said box-shaped container, said scene forming structure comprising a body forming a hollow interior, at least one extension member telescopingly received in said hollow interior of said body and at least one door providing access to said hollow interior.

14. A scene forming structure comprising:

a body forming a hollow interior;

at least one extension member telescopingly received in said hollow interior of said body;

at least one door attached to said body providing access to said hollow interior; and a foldable toy storage container which is movable between a first position for forming a substantially box-shaped toy storage container containing said body and a second position for forming a flat substantially rectangular play area.

15. The scene forming structure of claim 14 wherein a pair of extension members are telescopingly received in said body.

16. The scene forming structure of claim 15 wherein said scene forming structure is a representation of a mountain.

17. The scene forming structure of claim 15 wherein said representation of a mountain includes a representation of a ski slope surface on one side and a cliff on another side thereof.

18. The scene forming structure of claim 14 further including scenery forming panels releasably attached to said container.

* * * * *

UNITED STATES PATENT AND TRADEMARK OFFICE

CERTIFICATE OF CORRECTION

PATENT NO : 6,146,238
DATED : November 14, 2000
INVENTOR(S) : William K. Daiber

It is certified that error appears in the above-identified patent and that said Letters Patent is hereby corrected as shown below:

Column 6 Line 55, Claim 4, "of claim 1" should read --of claim 7--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*